US006609406B1

(12) United States Patent
Staquet

(10) Patent No.: US 6,609,406 B1
(45) Date of Patent: Aug. 26, 2003

(54) TOOL AND METHOD FOR REORIENTING A FLANGE

(75) Inventor: Edward T. Staquet, Broomall, PA (US)

(73) Assignee: Lord Corporation, Cary, NC (US)

( * ) Notice: Subject to any disclaimer, the term of this patent is extended or adjusted under 35 U.S.C. 154(b) by 0 days.

(21) Appl. No.: 10/201,231

(22) Filed: Jul. 23, 2002

(51) Int. Cl.[7] ..... B21D 5/16

(52) U.S. Cl. ..... 72/479; 72/176; 72/456; 29/243.51; 29/275

(58) Field of Search ..... 72/479, 176, 458; 29/34 R, 275, 243.57, 243.58

(56) References Cited

U.S. PATENT DOCUMENTS

| | | | | |
|---|---|---|---|---|
| 2,547,391 | A | | 4/1951 | Hauschild |
| 2,637,292 | A | | 5/1953 | George, Jr. |
| 2,810,420 | A | | 10/1957 | Gibson |
| 3,426,573 | A | | 2/1969 | Wilson, Jr. |
| 3,541,836 | A | | 11/1970 | Meis |
| 4,148,205 | A | | 4/1979 | Boysen |
| 4,176,541 | A | | 12/1979 | Cooper |
| 4,475,373 | A | | 10/1984 | Ikenberry |
| 4,926,536 | A | | 5/1990 | Kohut |
| 4,974,441 | A | | 12/1990 | Keeney |
| 5,052,209 | A | | 10/1991 | DeMaagd |
| 5,119,667 | A | | 6/1992 | Hollis et al. |
| 5,394,729 | A | | 3/1995 | Eisenhower, Jr. |
| 5,461,900 | A | | 10/1995 | Gutierrez |
| 5,730,021 | A | | 3/1998 | Johnson |
| 6,089,075 | A | | 7/2000 | Bramblett |
| 6,131,434 | A | | 10/2000 | Schneider, Jr. |
| 6,257,043 | B1 | * | 7/2001 | Wiens ..... 29/243.57 |
| 6,439,024 | B1 | * | 8/2002 | Staquet ..... 72/479 |
| 6,470,729 | B1 | * | 10/2002 | Hughes et al. ..... 72/479 |

FOREIGN PATENT DOCUMENTS

| | | |
|---|---|---|
| DE | 24 55 545 | 5/1976 |

* cited by examiner

*Primary Examiner*—David B. Jones
(74) *Attorney, Agent, or Firm*—Michael M. Gnibus; Edward F. Murphy, III

(57) ABSTRACT

A tool for reorienting a flange is disclosed. The tool reorients the flange from a first angle of orientation to a second angle of orientation and comprises a support member that further comprises a guide member; and a shoe maintained in a desired orientation by the support member. The shoe defines a reorienting surface, and the reorienting surface further comprising: a leading reorienting surface for progressively reorienting the flange to an intermediate angle of orientation between the first and second angles of orientation, and a trailing reorienting surface, the trailing reorienting surface being located proximate the guide member to define a reorienting gap therebetween, said reorienting gap adapted to permit passage of the flange therethrough, said flange being reoriented to the second angle as it exits the reorienting gap.

4 Claims, 5 Drawing Sheets

TOOL AND METHOD FOR REORIENTING A FLANGE

FIELD OF THE INVENTION

The invention relates to a reorienting tool that simply and efficiently reorients a flange, such as a hem flange, and such hem flange in combination with an adhesive serves to make integral the outer skin of a vehicle door and a vehicle door frame, and more specifically the invention relates to a hem flange reorienting tool and method whereby as the tool is moved along the length of the hem flange, the tool contacts the flange to thereby reorient the flange in the manner required to make integral the vehicle door and frame.

BACKGROUND OF THE INVENTION

A vehicle door such as a door for a car or truck is generally comprised of a door frame and an outer door skin that is made integral with the frame at a hem flange defined by the perimeter edge of the skin. During the door assembly process, a suitable adhesive is placed proximate the peripheral door skin edge. The skin is then placed in the required position on the door frame and the desired hem flange is formed as the perimeter edge of the skin is bent around the frame and towards the frame until the flange is closely adjacent the frame. The adhesive is sandwiched between the hem flange and the frame and forms the desired bond therebetween. Finally, to ensure the requisite continuous, leakproof and tight bond is developed between the hem flange and doorframe, suitable tools such as pliers or a hammer, are used to press, crimp or otherwise force the flange further against the frame.

Over time, if the door becomes damaged or develops rust, the door panel skin must be replaced. In order to replace the skin, the hem flange is first broken using a time consuming process. This prior art process is well known to those skilled in the art. Initially during the skin replacement process a grinding wheel is applied at the flange bend and the flange is ground to a minimum thickness at the bend. During this step in the replacement process, the grinding wheel is moved along the hem flange bend until it is possible to physically separate the main skin portion from the hem. The hem flange is then manually peeled away from the door frame using a chisel. Occasionally it may be necessary to use a hand held tool such as pliers to separate the hem and skin. Finally, the skin is removed from the door frame. It may be necessary to apply an air chisel or another suitable well known manually or pneumatically actuated tool between the skin and frame to break apart the members. Any remaining dried adhesive on the frame is then removed from the frame using a solvent, sandpaper or a suitable tool.

During this prior art removal process, the frame is frequently damaged by the removal tools. Because the new skin is sized to mate with a door frame of precise dimensions, in order to ensure the required bond between the skin and frame is formed, the frame must be reformed and returned to its initial precise dimensions and configuration. Therefore, after removing the hem flange from the door frame and before the new door skin is attached to the frame, it is often necessary for a technician to manually reshape and repair the frame using a hammer and dolly in order to be able to effectively attach the new skin to the door frame. Repairing and reforming the door frame can be a time consuming and expensive process.

Once the frame and skin have been reshaped for effective mating, an adhesive is applied along the periphery of the frame and the hem flange is then bent around the frame to a location proximate the door frame so that the adhesive is sandwiched between the hem flange and door frame. The adhesive forms the desired bond between the flange and frame. The hem flange may be repositioned to a location proximate the door frame using any one or more of known manual repositioning methods such as for example, by striking the flange with a hammer and dolly. Such manual prior art repositioning techniques are time consuming, imprecise and frequently damage the door as the hem flange is struck or gripped and repositioned. Any damage sustained by the door as the joint is formed between the frame and skin must be repaired and as a result undesirably increase the time and cost to repair the door.

The foregoing illustrates limitations known to exist in present tools and methods for repairing flanges in general and more specifically flanges joining door frames and outer door skins. Thus, it is apparent that it would be advantageous to provide an alternative directed to overcoming one or more of the limitations set forth above. Accordingly, a suitable alternative for quickly and precisely repositioning a flange is provided including features more fully disclosed hereinafter.

SUMMARY OF THE INVENTION

In one aspect of the present invention this is accomplished by providing a tool for effectively and precisely reorienting a flange such as a hem flange for example. The tool reorients the flange from a first angle of orientation to a second angle of orientation and comprises a support member that further comprises a guide member; and a shoe maintained in a desired orientation by the support member. The shoe defines a reorienting surface, and the reorienting surface further comprising: a leading reorienting surface for progressively reorienting the flange to an intermediate angle of orientation between the first and second angles of orientation, and a trailing reorienting surface, the trailing reorienting surface being located proximate the guide member to define a reorienting gap therebetween, said reorienting gap adapted to permit passage of the flange therethrough, said flange being reoriented to the second angle as it exits the reorienting gap.

The progressive flange reorientation is primarily a result of the semi-frustoconical shape of the leading portion of the reorienting surface. The leading portion of the reorienting surface is tapered inwardly as it extends outwardly from the support member to a side shoe surface. The angle of taper may be between thirty and forty-five degrees.

The trailing reorienting surface is planar and is substantially parallel to the guide member. The orienting gap is of a dimension sufficient to permit the interleaved portion of the flange, door frame and outer skin to pass therebetween.

The flange reorienting tool of the present invention may be attached to a pneumatically actuated tool such as an air hammer.

According to the method of the present invention the tool contacts the flange which is oriented in an initial orientation at a first angle relative to the door skin as the tool is moved along the flange; (b) progressively urges the flange toward the skin and (c) finally reorients the flange as the flange passes through the reorienting gap. In this way, the flange is reoriented efficiently and precisely by the tool and method of the present invention.

The foregoing and other aspects will become apparent from the following detailed description of the invention when considered in conjunction with the accompanying drawing figures.

DETAILED DESCRIPTION OF THE PREFERRED EMBODIMENT

Figure 1:
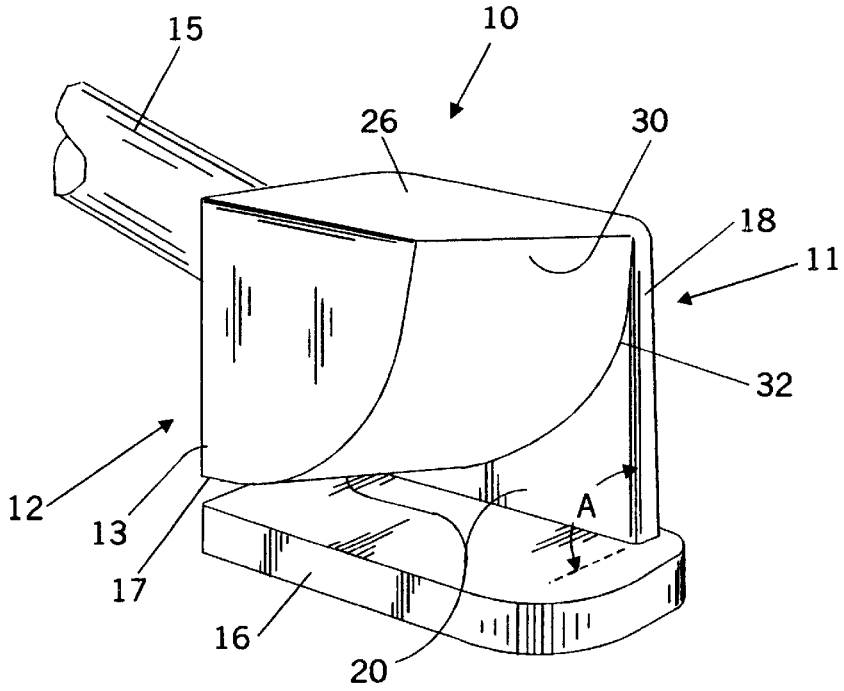
FIG. 1 is an isometric view illustrating top, front and left side views of the flange reorienting tool of the present invention.
Figure 2A:
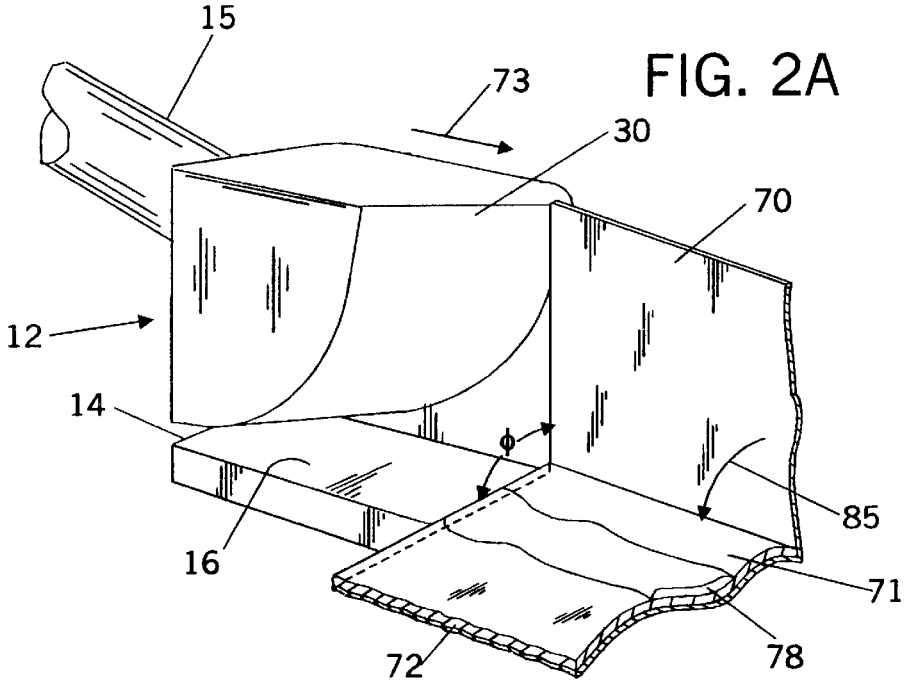
FIG. 2A is an isometric view of the flange reorienting tool of the present invention as shown in FIG. 1 and also includes a segment of a typical interleaved door frame and skin with a flange in an initial orientation, and illustrates an initial step in the method for reorienting the flange as the flange contacts the leading portion of the tool as the tool is displaced along the interleaved frame and skin segment.
Figure 2B:
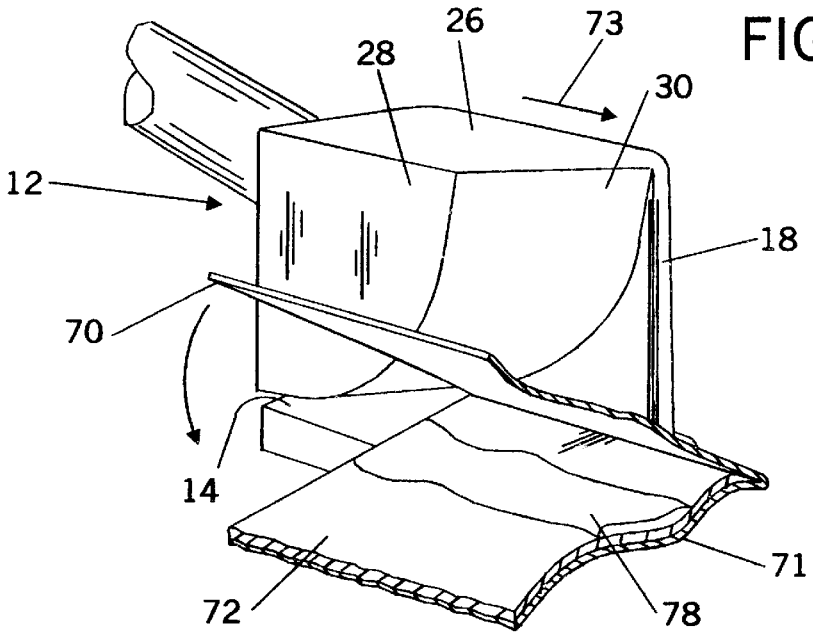
FIG. 2B is the isometric view as shown in FIG. 2A and illustrates an intermediate portion of the method for reorienting the flange as the flange segment is partially reoriented by the tool as the tool is displaced along the length of the interleaved frame and skin segment and the flange segment is in contact with the tool reorienting surface.
Figure 2C:
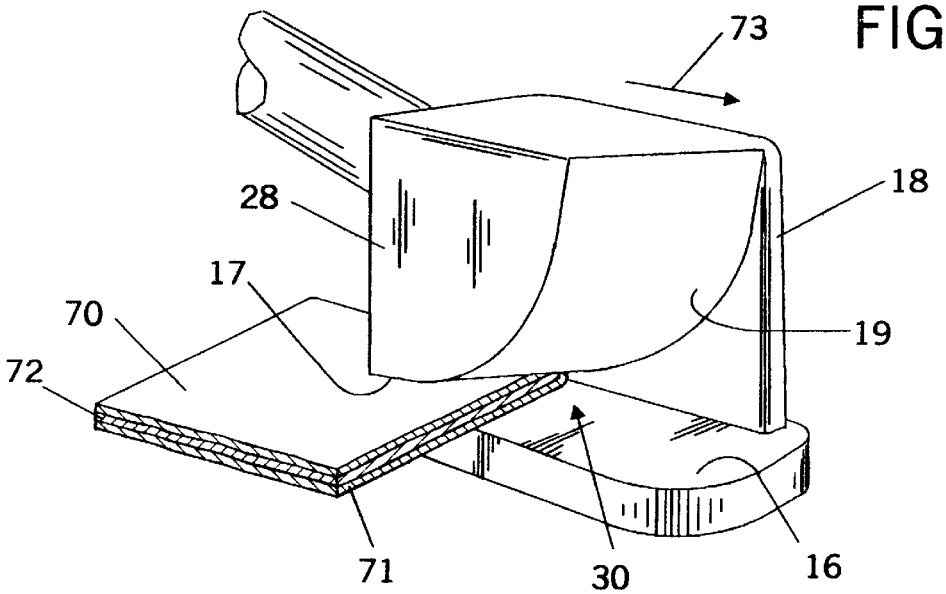
FIG. 2C is the isometric view as shown in FIG. 2A and illustrates a final portion of the flange reorienting method as the tool is moved passed the interleaved frame and skin segment and the flange is reoriented to a desired final orientation.

The invention relates to a device and method for reorienting a flange, such as a hem flange located along the outer periphery of a vehicle door skin where the reoriented hem flange, in combination with an adhesive applied at the flange, maintain the door frame and outer door skin integral. Now turning to the drawing figures wherein like parts are referred to by the same numbers in the several views, FIGS. 1–3C illustrate a preferred embodiment of the flange reorienting tool 10 of the present invention. The method of the present invention utilizing reorienting tool 10 is generally represented in FIGS. 2A–2C, 5, 6A, 6B and 7. For clarity, as the description proceeds, the invention 10 may generally be referred to as "a tool", "a reorienting tool" or "a flange reorienting tool". As shown in FIGS. 2A–2C the flange reorienting tool of the present invention generally: (a) contacts the flange 70 which is oriented in an initial orientation at a first angle, Ø, relative to the door skin 71, as the tool is moved along the flange in direction 73 as shown in FIG. 2A; (b) progressively urges the flange 70 toward the skin 71 and frame 72 as the flange further contacts leading reorienting surface 19 of tool shoe member 12 as the tool is further displaced in direction 73, see FIG. 2B and (c) finally reorients the flange 70 to the orientation shown in FIG. 2C as the flange passes through the gap 14 defined between the substantially planar trailing reorienting shoe surface 17 and guide member 16 so that in its final orientation the flange and door frame are in an interleaved configuration. As the description proceeds, for simplicity, throughout the drawing Figures, only a portion of the flange 70, skin 71 and frame 72 are shown. However, it should be understood that the functionality of the tool as related to the reorientation of the illustrated flange, skin and frame section applies to the skin, frame and flange along their entire respective lengths.

The tool 10 of the present invention is unitary and is preferably made from a metal and is most preferably made from a forged steel. The tool comprises an L-shaped guide support 11 that further comprises an upwardly extending support member 18 and guide member 16 that is substantially perpendicular to the support member 18. The support member 18 and guide member 16 define a tool interior 20. Although the guide support 11 is disclosed as having an L-shaped configuration with support 11 and member 16 being separated by an angle, A of about ninety degrees, it should be understood that the support 11 and member 16 may be separated by any suitable relative angle.

Figure 3B:
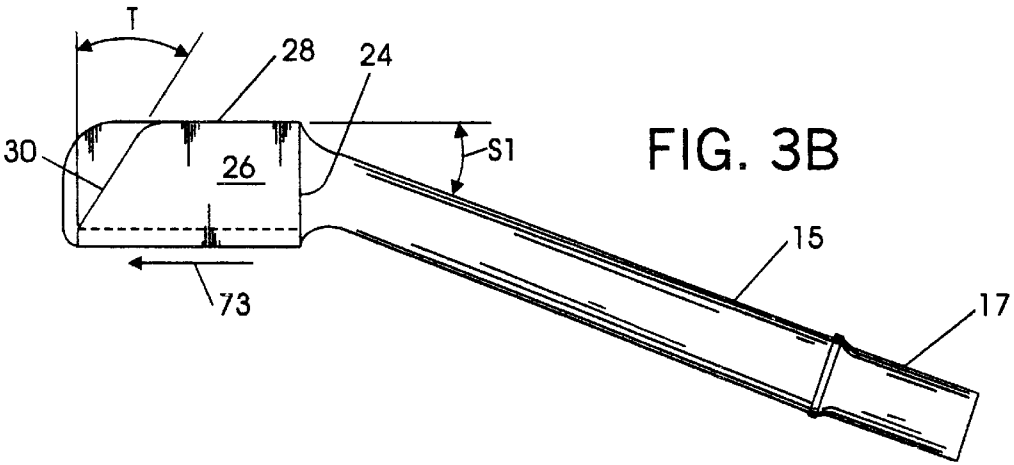
FIG. 3B is a top view of the reorienting tool of the present invention illustrated in FIG. 1.
Figure 3C:
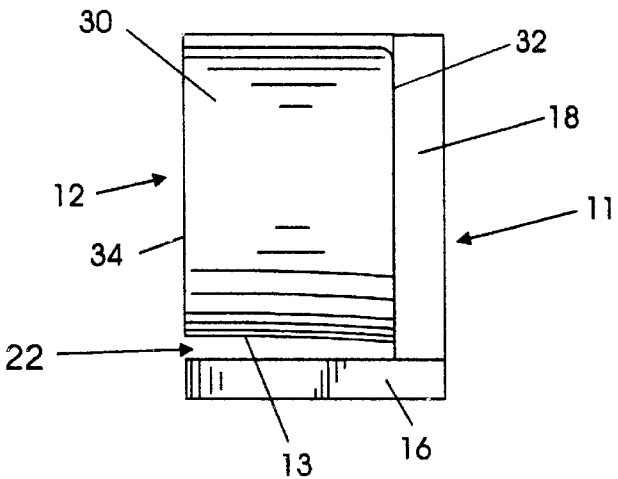
FIG. 3C is a front view of the reorienting tool of the present invention shown in FIG. 1.
Figure 3A:
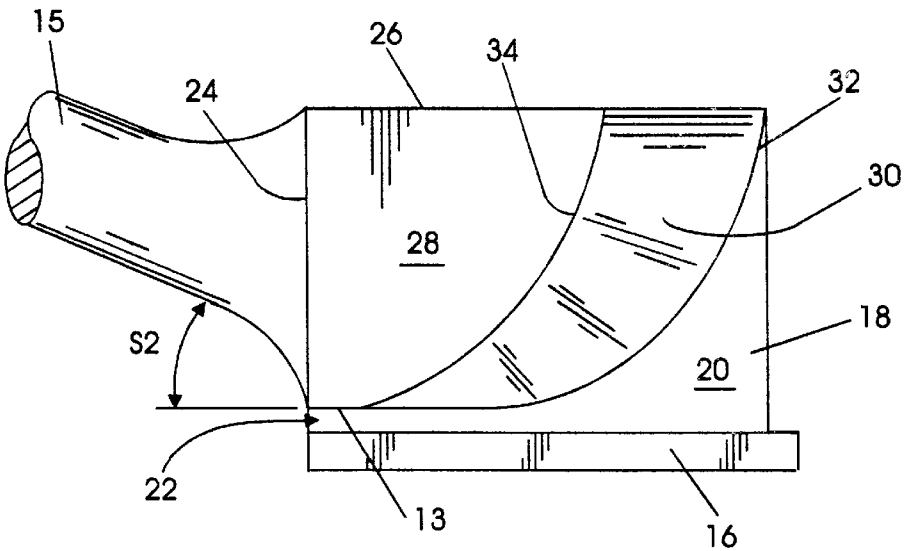
FIG. 3A is a left side view of the reorienting tool of the present invention illustrated in FIG. 1.

As indicated above, unitary flange reorienting tool 10 also comprises shoe member 12 that is supported by member 18 and the shoe extends outwardly from member 18 into the defined tool interior 20. As shown in FIG. 3C, shoe 12 is spaced away from guide member 16 and at the trailing portion of 13 of the shoe 12 the shoe includes a substantially planar trailing orienting surface 17 that is substantially parallel to the guide member 16 and in combination with the guide member 16 define an orienting gap 22. The surface 17 and guide member 16 are separated by a distance sufficient to facilitate the smooth passage of the interleaved portions of the door frame 72, door skin 71 and reoriented flange 70 through the reorienting gap 22.

The shoe 12 comprises rear surface 24, top surface 26 and exterior side surface 28, and the surfaces 24, 26 and 28 are substantially planar. An attachment shaft 15 extends outwardly from the rear shoe surface, at an angle identified as S1, of about twenty-five degrees (25°) relative to surface 28 and at an angle S2 of about thirty degrees (30°) relative to the rear surface 24. The shaft is connected to a means for displacing the tool along the flange. Orienting the shaft 15 at relative angles S1 and S2 locates the free, attachment end 17 of the shaft away from the tool body and as a result ensures that the tool actuation means is located away from the flange and does not interfere with the flange reorientation as the tool is displaced along the interleaved frame and skin. The actuation means attached to the shaft 15 at end 17 may be a conventional pneumatically actuated hammer 80 as shown schematically in FIG. 5 for example. With additional fixturing, the tool 10 may be hand held or manually manipulated. However due to the complexity associated with fixturing such a manually manipulated device, the preferred mode of actuation is through a means such as the pneumatic device of FIG. 5.

Returning to drawing FIGS. 1–3C, the shoe 12 comprises a unitary reorienting surface 30 that further comprises a substantially semi-frustoconical leading reorienting surface 19 and a substantially planar trailing reorienting surface 17. By tapering the leading reorienting surface inwardly in the direction of displacement, the leading reorienting surface serves to progressively reorient the flange from its initial orientation to an intermediate orientation in which it is located in the reorienting gap. The planar trailing reorienting surface is located downstream from the leading reorienting surface in the direction of motion 73. The leading portion 19 of the reorienting surface 30 tapers inwardly as it extends from the guide member 18 to the exterior side surface 28 at an angle T, which may be about forty-five degrees (45°) for example. The taper angle T, is shown in FIG. 3B. As shown in FIG. 1 the leading edge 32 of the leading reorienting surface is located proximate the guide member 18. The reorienting surface 30 spans an angle of ninety degrees (90°) between top and rear surfaces 26 and 24. The contour of the leading reorienting surface is arcuate as the surface extends longitudinally. The contoured reorienting surface 30 extends outwardly, laterally from the support member 18 and joins the top, side and rear surfaces. The trailing reorienting surface 17 extends longitudinally between the leading reorienting surface 19 and the rear surface 24. For reference purposes, the lateral direction as referred to hereinafter is substantially perpendicular to the direction of tool displacement 73, and the longitudinal direction is generally aligned with the direction of tool displacement. As a result of the generally arcuate, tapered contour of the reorienting surface 30, the tool 10 of the present invention produces gradual, precise and effective reorientation of the flange member 70. The reorientation of the flange from its initial orientation to an intermediate orientation in which it is located in the reorienting gap is achieved smoothly and progressively by the tool of the present invention.

Operation of tool 10 will now be described.

The tool 10 of the present invention serves to reorient a flange in a precise, effective and efficient manner regardless of the means used to actuate or displace the tool along the flange. Therefore, as the description of the operation of tool proceeds the pneumatic tool 80 of FIG. 5 will be described as the actuation means however it should be understood that any suitable actuation means may be utilized to displace the tool 10 in order to reorient a flange. Also, as the description of the use of the tool proceeds the description will comprise use of the tool to reorient a hem flange in a vehicle door. It should be understood however that such use is exemplary and the description of such specific use is made in order to provide a description of a preferred embodiment of the invention, and the tool may be used to reorient flanges in a variety of applications. It should be understood that the edges between adjacent tool surfaces are rounded and smooth and are not sharp. In this way the tool does not gouge the door and flange as the tool is moved along the hem flange.

Figure 4:
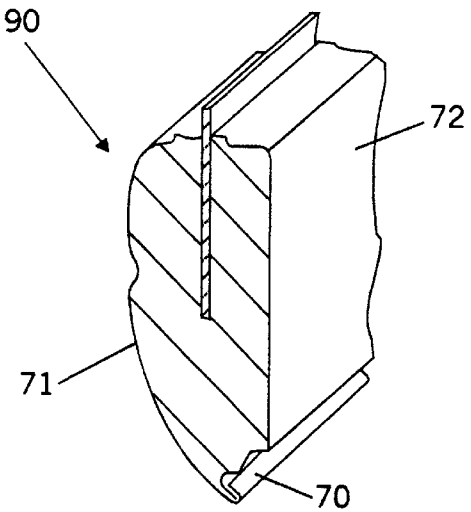
FIG. 4 is a schematic representation of a partial section of a vehicle door illustrating the attached door frame and door skin.
Figure 5:
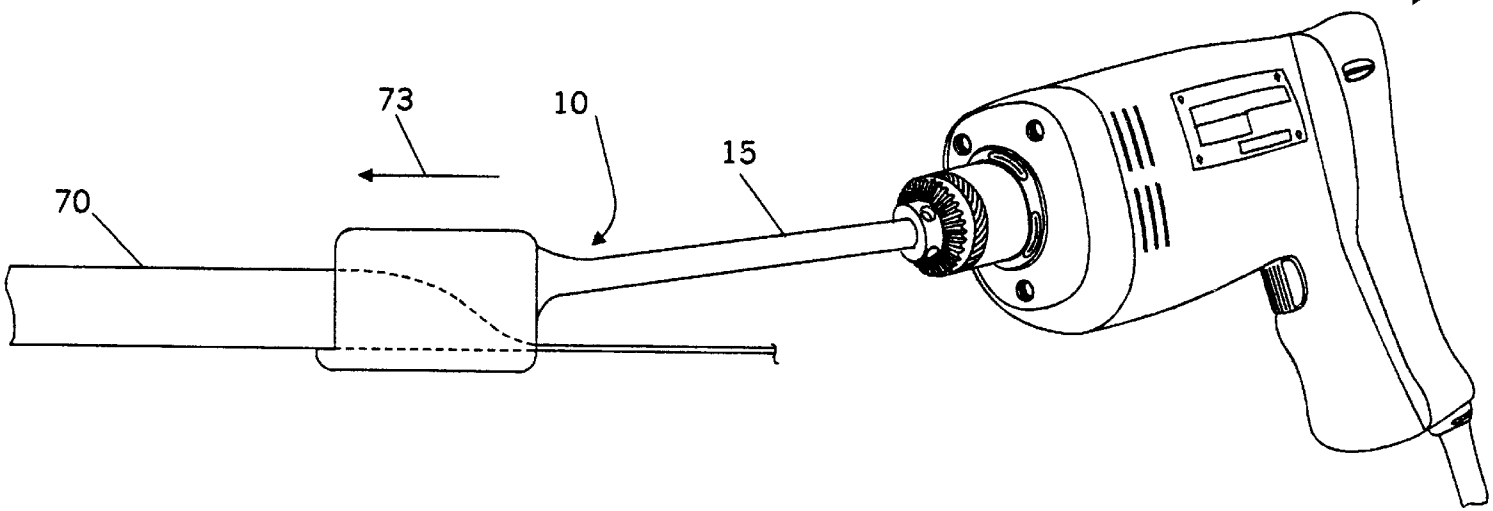
FIG. 5 is a schematic representation of the tool of the present invention attached to a pneumatically actuated device.
Figure 6B:
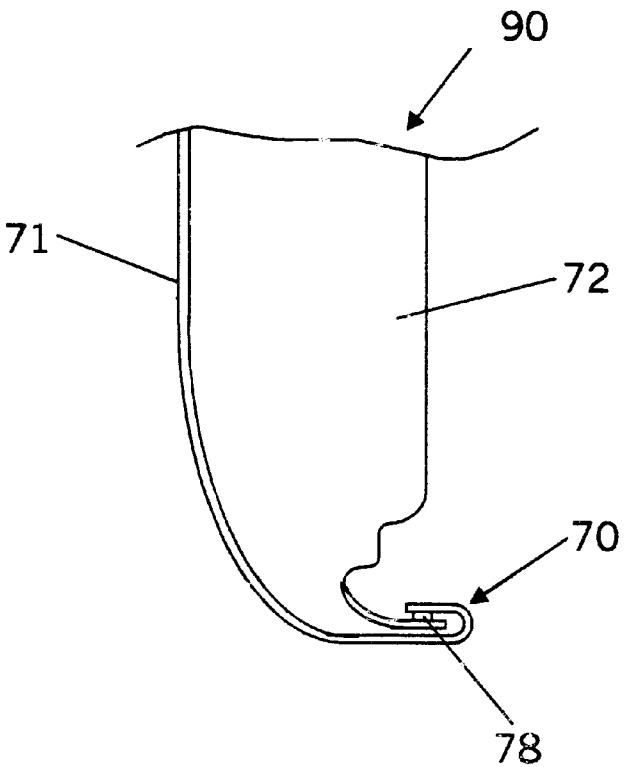
FIGS. 6A and 6B respectively represent the relative positions between the door frame and flange before and after the flange reorienting tool is moved across the interleaved frame and flange.
Figure 6A:
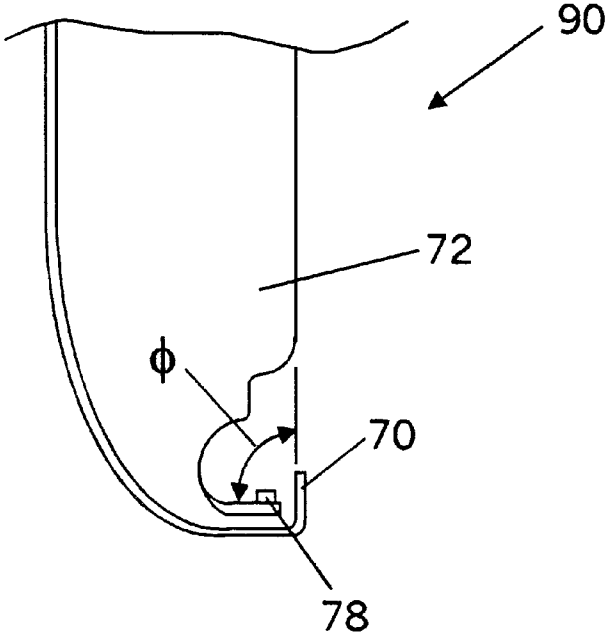

Turning to FIGS. 4, 6A and 6B, after the skin 71 of door 90 has been repaired or replaced and it is necessary to make the skin 71 and frame 72 integral, the tool 10 is moved along the flange to reorient the flange 70 against the frame. As shown in FIG. 6A, the angle of separation between flange 70 and frame 72 identified by Ø, is equal to about ninety degrees (90°). The tool of the present invention is suited to reorient a flange oriented at any angle having a value that is greater than zero and less than ninety degrees. For purposes of describing the present invention, as illustrated in FIGS. 6A and 6B, the flange 70 is reoriented ninety degrees by tool 10, however the tool may be modified to reorient flange 70 or any flange by any desired angle.

For purposes of describing the operation of the preferred embodiment of the invention it is assumed that the flange and frame are bonded by adhesive 78, and that as the flange is reoriented the adhesive between the flange and frame is sandwiched therebetween and serves to produce the required bond between the frame and flange. However the flange and frame may be alternatively made integral by a welding process such as a well known, conventional tack welding process.

After the skin is properly located along the frame, a bead of a suitable adhesive 78, such as Fusor® adhesive sold by Lord Corporation of Erie, Pa. is placed along the periphery of frame 72 proximate the flange member 70.

The entire flange length is reoriented in the same manner so for brevity, only the reorientation of the flange end shown in FIGS. 2A–2C will be described. The tool 10 is located at one end of the flange 70 and oriented at the flange end with the flange 70 located against the support member 18 and the skin 71 seated on the guide member 16 such as in the manner illustrated in FIG. 2A. The flange is in an initial orientation with flange end 70 in contact with the leading orienting surface 19 proximate the leading edge 32. As tool 10 is displaced by the actuation means in direction 73, the flange end is progressively and smoothly urged toward frame 72 in direction 85 of FIG. 2A. Further displacement of tool 10 in direction 73 moves the flange segment further along leading reorienting surface 19 and thereby progressively reorients the flange closer to frame 72 to an intermediate orientation between the initial and final flange orientations. See FIG. 2B. The smooth progressive reorientation of the flange toward frame 72 continues until the flange 70, frame 72 and skin 71 are interleaved. Final reorientation occurs when the interleaved flange, frame and skin pass through the reorienting gap 22 between guide member 16 and trailing reorienting surface 17. The bead of adhesive squeezed between the flange and frame serves to maintain the flange segment against the frame. In its final orientation, the flange is essentially parallel to the frame.

The process is repeated along the entire length of the flange. If adhesive is not used to make the skin integral with the frame, the process is applied to the door after the flange has been reoriented.

While I have illustrated and described a preferred embodiment of my invention, it is understood that this is capable of modification and therefore I do not wish to be limited to the precise details set forth, but desire to avail myself of such changes and alterations as fall within the purview of the following claims.

I claim:

1. A vehicle door skin replacement repair tool for reorienting a vehicle door hem flange member of a vehicle door skin from an open-first angle of orientation with a vehicle door frame having a bead of adhesive, said vehicle door frame between said vehicle door skin and said vehicle door hem flange member,—to a closed second angle of orientation with the adhesive sandwiched between the vehicle door hem flange and the vehicle door frame, the vehicle door skin replacement repair tool comprising a single unitary forged metal tool body including:

a L-shaped guide support with an upwardly extending support member and a guide member, said guide member substantially perpendicular to said support member, said support member and said guide member defining a vehicle door hem flange reorienting tool interior and a shoe member supported by said upwardly extending support member, said shoe member extending outwardly from said support member into said vehicle door hem flange reorienting tool interior, said shoe member spaced away from said guide member, said shoe member having a unitary reorienting surface that has a substantially semi-frustoconical leading reorienting surface and a trailing portion which includes a substantially planar trailing reorienting surface, said substantially planar trailing reorienting surface substantially parallel to said guide member, said substantially planar trailing reorienting surface and said parallel guide member defining a trailing reorienting gap therebetween, said shoe member leading reorienting surface progressively tapered down to said trailing reorienting surface wherein said reorienting surface progressively reorients said vehicle door hem flange member from said open first angle of orientation into contact with said bead of adhesive and squeezes said adhesive between said vehicle door hem flange member and said vehicle door frame with said vehicle door frame interleaved between said vehicle door hem flange member and said vehicle door skin into said closed second angle of orientation with the adhesive sandwiched between the vehicle door hem flange and the vehicle door frame, said trailing reorienting gap sized and adapted to permit progressively exiting passage of said interleaved closed second angle of orientation vehicle door skin, vehicle door frame, vehicle door hem flange member and squeezed adhesive from said unitary metal tool body.

2. A method of replacement repairing a vehicle door skin, said method comprising: providing a vehicle door hem flange member of a vehicle door skin with an open first angle of orientation with a vehicle door frame having a bead of adhesive, said vehicle door frame between said vehicle door skin and said vehicle door hem flange member, providing a vehicle door skin replacement repair tool having a single unitary forged metal tool body including a L-shaped guide support with an upwardly extending support member and a guide member, said guide member substantially perpendicular to said support member, said support member and said guide member defining a vehicle door hem flange reorienting tool interior; and a shoe member supported by said upwardly extending support member, said shoe member extending outwardly from said support member into said vehicle door hem flange reorienting tool interior, said shoe member spaced away from said guide member, said shoe member having a unitary reorienting surface that has a substantially semi-frustoconical leading reorienting surface and a trailing portion which includes a substantially planar trailing reorienting surface, said substantially planar trailing reorienting surface substantially parallel to said guide member, said substantially planar trailing reorienting surface and said parallel guide member defining a trailing reorienting gap therebetween, said shoe member leading reorienting surface progressively tapered down to said trailing reorienting surface, progressively displacing said provided vehicle door skin replacement repair tool along said open first angle of orientation vehicle door hem flange member wherein said reorienting surface progressively reorients said vehicle door hem flange member from said open first angle of orientation into contact with said bead of adhesive and squeezes said adhesive between said vehicle door hem flange member and said vehicle door frame with said vehicle door frame interleaved between said vehicle door hem flange member and said vehicle door skin into a closed second angle of orientation with the adhesive sandwiched between the vehicle door hem flange and the vehicle door frame, said interleaved closed second angle of orientation vehicle door skin, vehicle door frame, vehicle door hem flange member and squeezed adhesive bead progressively exiting from said unitary metal tool body through said trailing reorienting gap with said trailing reorienting gap sized and adapted to permit said progressively exiting of said interleaved closed second angle of orientation vehicle door skin, vehicle door frame, vehicle door hem flange member and squeezed adhesive from said unitary metal tool body.

3. A method of replacement repairing a vehicle door skin, said method comprising: providing a vehicle door hem flange member of a vehicle door skin with an open first angle of orientation with a vehicle door frame, said vehicle door frame between said vehicle door skin and said vehicle door hem flange member, providing a bead of adhesive between said vehicle door hem flange member and said vehicle door frame, providing a vehicle door skin replacement repair tool having a single unitary metal tool body including a L-shaped guide support with an upwardly extending support member and a guide member, said guide member substantially perpendicular to said support member, said support member and said guide member defining a vehicle door hem flange reorienting tool interior; and a shoe member supported by said upwardly extending support member, said shoe member extending outwardly from said support member into said vehicle door hem flange reorienting tool interior, said shoe member spaced away from said guide member, said shoe member having a unitary reorienting surface that has a substantially semi-frustoconical leading reorienting surface and a trailing portion which includes a substantially planar trailing reorienting surface, said substantially planar trailing reorienting surface substantially parallel to said guide member, said substantially planar trailing reorienting surface and said parallel guide member defining a trailing reorienting gap therebetween, said shoe member leading reorienting surface progressively tapered down to said trailing reorienting surface, progressively displacing said provided vehicle door skin replacement repair tool along said open first angle of orientation vehicle door hem flange member wherein said reorienting surface progressively reorients said vehicle door hem flange member from said open first angle of orientation into contact with said bead of adhesive and squeezes said adhesive between said vehicle door hem flange member and said vehicle door frame with said vehicle door frame interleaved between said vehicle door hem flange member and said vehicle door skin into a closed second angle of orientation with the adhesive sandwiched between the vehicle door hem flange and the vehicle door frame, said interleaved closed second angle of orientation vehicle door skin, vehicle door frame, vehicle door hem flange member and squeezed adhesive bead progressively exiting from said unitary metal tool body through said trailing reorienting gap.

4. A method of replacement repairing a vehicle door skin, said method comprising: providing a vehicle door hem flange member of a vehicle door skin with an open first angle of orientation with a vehicle door frame, said vehicle door frame between said vehicle door skin and said vehicle door hem flange member, providing a bead of adhesive between said vehicle door hem flange member and said vehicle door frame, providing a vehicle door skin replacement repair tool having a unitary metal tool body including a guide support with an upwardly extending support member and a guide member, said support member and said guide member defining a vehicle door hem flange reorienting tool interior; and a shoe member supported by said upwardly extending support member, said shoe member extending outwardly from said support member into said vehicle door hem flange reorienting tool interior, said shoe member spaced away from said guide member, said shoe member having a unitary reorienting surface that has a leading reorienting surface for initial contact with said hem flange member and a trailing portion which includes a substantially planar trailing reorienting surface, said substantially planar trailing reorienting surface substantially parallel to said guide member, said substantially planar trailing reorienting surface and said parallel guide member defining a trailing reorienting gap therebetween, said shoe member leading reorienting surface progressively tapered down to said trailing reorienting surface, progressively displacing said provided vehicle door skin replacement repair tool along said open first angle of orientation vehicle door hem flange member wherein said leading reorienting surface progressively reorients said vehicle door hem flange member from said open first angle of orientation into contact with said bead of adhesive at an intermediate orientation angle and squeezes said adhesive between said vehicle door hem flange member and said vehicle door frame with said vehicle door frame interleaved between said vehicle door hem flange member and said vehicle door skin into a closed second angle of orientation with the adhesive sandwiched between the vehicle door hem flange and the vehicle door frame, said interleaved closed second angle of orientation vehicle door skin, vehicle door frame, vehicle door hem flange member and squeezed adhesive progressively exiting from said unitary metal tool body through said trailing reorienting gap with a closed final angle of orientation.

* * * * *